US007286892B2

(12) United States Patent
Nicastro et al.

(10) Patent No.: US 7,286,892 B2
(45) Date of Patent: Oct. 23, 2007

(54) CUTTING DEVICE

(75) Inventors: Francesco Nicastro, Imola (IT); Maurizio Cotti, San Giovanni in Persiceto (IT); Giorgio Mylonopoulos, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 16 days.

(21) Appl. No.: 11/390,712

(22) Filed: Mar. 28, 2006

(65) Prior Publication Data

US 2006/0224266 A1 Oct. 5, 2006

(30) Foreign Application Priority Data

Mar. 31, 2005 (IT) ..... BO2005A0205

(51) Int. Cl.
*G06F 19/00* (2006.01)

(52) U.S. Cl. ..... 700/122; 83/931

(58) Field of Classification Search ..... 700/108, 700/109, 122, 167, 174; 83/72, 76.4, 112, 83/931

See application file for complete search history.

(56) References Cited

U.S. PATENT DOCUMENTS 3,633,448 A 1/1972 Maw
4,928,713 A 5/1990 Arthur et al.
5,050,471 A 9/1991 Niemann et al.
5,241,886 A * 9/1993 Church et al. ..... 83/174
5,711,318 A * 1/1998 Saitoh et al. ..... 131/84.1
5,816,261 A * 10/1998 Dyett ..... 131/84.4
6,026,574 A * 2/2000 Ghavami et al. ..... 30/109
6,062,226 A * 5/2000 Kida ..... 131/84.1
6,250,310 B1 * 6/2001 Spatafora ..... 131/84.4
6,918,328 B2 * 7/2005 Wohltmann ..... 83/310
2002/0052271 A1 5/2002 Schicke

FOREIGN PATENT DOCUMENTS

GB 652561 4/1951

OTHER PUBLICATIONS

European Search Report in EP 06 11 1788 dated Jul. 6, 2006.

* cited by examiner

*Primary Examiner*—Leo Picard
*Assistant Examiner*—Chad Rapp
(74) *Attorney, Agent, or Firm*—Marshall Gerstein & Borun LLP

(57) ABSTRACT

A cutting device having cutting means for cutting a cigarette rod transversely along a cutting plane; a carriage for accompanying the rod through the cutting plane; an operating unit for moving the carriage back and forth in a travelling direction crosswise to the cutting plane; and a control unit, in turn having two proximity sensors, and which determines at least one fault on the operating unit as a function of recording signals emitted by the sensors.

14 Claims, 3 Drawing Sheets

CUTTING DEVICE

CROSS-REFERENCE TO RELATED APPLICATION

This application claims the benefit of Italian patent application number BO2005A 000205, filed 31 Mar. 2005.

The present invention relates to a cutting device.

BACKGROUND OF THE INVENTION

More specifically, the present invention relates to a cutting device for cutting a rod of material in the tobacco industry into substantially cylindrical portions. The device comprises a cutting assembly for cutting the rod along a given cutting plane; a rod-guide carriage for accompanying the rod and the portions through the cutting plane; and an operating unit for moving the carriage back and forth in a direction crosswise to the cutting plane. The carriage comprises at least one channel for supporting the rod and the portions at the cutting plane, and through which the rod and the portions travel in use.

In known devices of the above type, it is relatively essential that the rod-guide carriage move along a given path to prevent the article from being damaged or even lost as it travels through the cutting plane. Moreover, incorrect positioning of the rod-guide carriage may result in the rod being cut in the wrong position.

At present, faults on the cutting device resulting in incorrect positioning of the rod-guide carriage are extremely difficult and slow to determine. This, combined with the high operating speeds of modern cutting devices, therefore results in a relatively large number of rejects downstream from the cutting device and, consequently, in increased production costs.

SUMMARY OF THE INVENTION

It is an object of the present invention to provide a cutting device designed to eliminate the aforementioned drawbacks, and which, in particular, is cheap and easy to produce.

According to the present invention, there is provided a cutting device as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
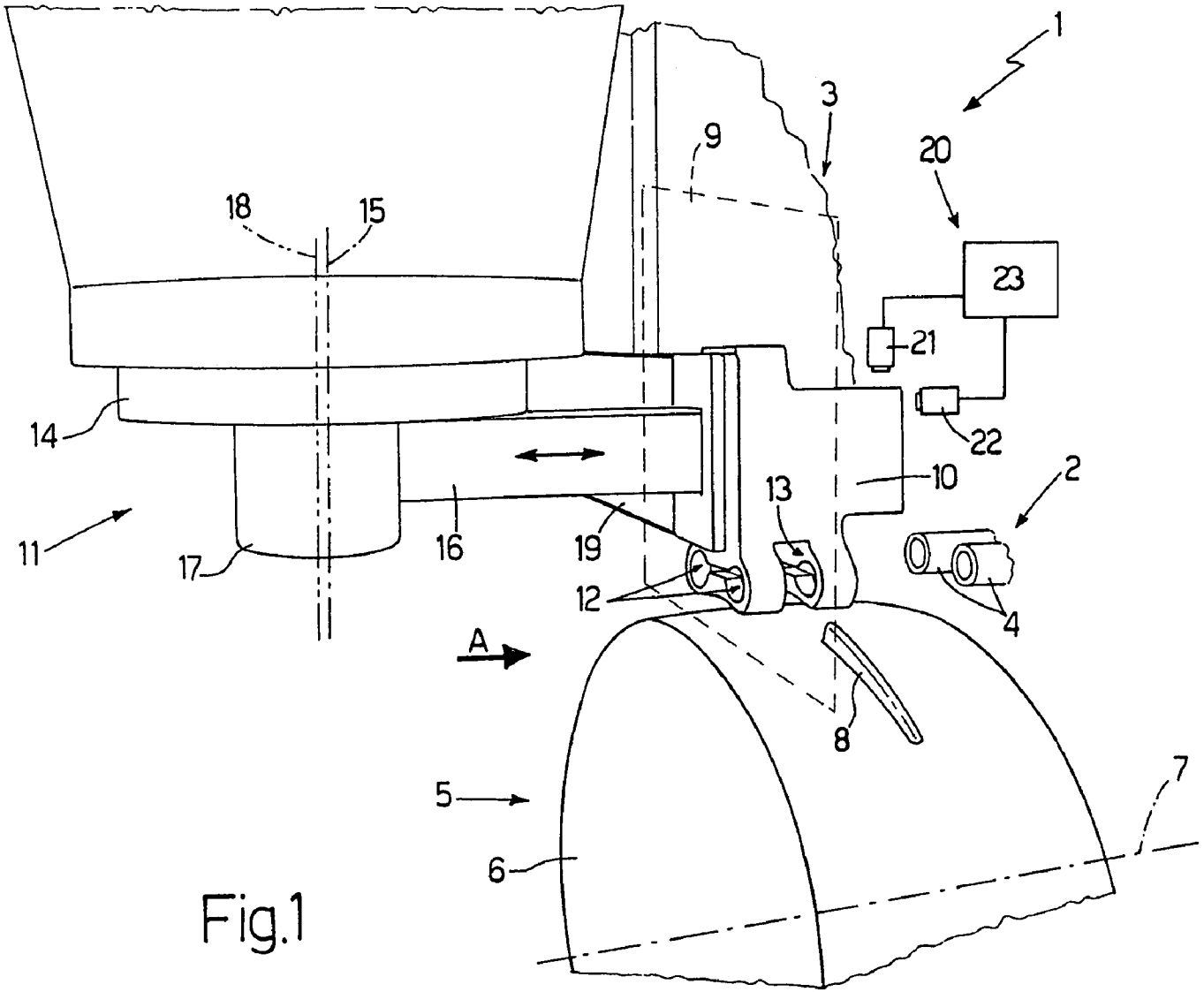
FIG. 1 shows a schematic view in perspective of a cutting device in accordance with the present invention.

Number 1 in FIG. 1 indicates as a whole a machine for producing cigarettes (not shown) and comprising a feed unit 2 (shown partly) for feeding two cigarette rods (not shown), i.e. tobacco rods wrapped in paper, to a cutting device 3 which cuts the rods into substantially cylindrical cigarette portions (not shown) of substantially constant length; and an unloading unit (not shown) for receiving the cigarette portions (not shown) from cutting device 3.

Feed unit 2 comprises two substantially parallel channels 4, inside which the rods (not shown) travel in a travelling direction A.

Cutting device 3 comprises a cutting assembly 5 having a roller 6, which rotates about a respective horizontal axis 7 substantially parallel to direction A, and has a peripheral blade 8 oriented crosswise, in particular perpendicular, to direction A. In actual use, as it rotates about axis 7, blade 8 cuts the rods (not shown) along a cutting plane 9 crosswise, in particular perpendicular, to direction A.

Cutting device 3 also comprises a rod-guide carriage 10 for accompanying the rod (not shown) and the cigarette portions (not shown) through cutting plane 9; and an operating unit 11 for moving carriage 10 back and forth in a direction crosswise to cutting plane 9, in particular in direction A.

Carriage 10 comprises two channels 12, each for supporting a respective rod and respective cigarette portions (not shown) at cutting plane 9, and through each of which a respective rod and respective cigarette portions (not shown) are fed. Carriage 10 also comprises a gap 13 dividing channels 12 substantially in half, and through which blade 8 passes, in use, as it rotates about axis 7.

Operating unit 11 comprises a roller 14 rotating about a respective vertical axis 15; and an arm 16 substantially parallel to direction A and connected to roller 14 by a shaft 17 which rotates about a respective vertical axis 18 offset with respect to axis 15. Arm 16 is also connected by a hinge (not shown) to carriage 10; and shaft 17 and carriage 10 are located at opposite ends of arm 16.

Operating unit 11 also comprises a substantially parallelepiped-shaped elastic member 19 connected at opposite ends to carriage 10 and to a fixed frame (not shown) of machine 1.

Cutting device 3 also comprises a control unit 20 for detecting faults on the operating unit, and in turn comprising two proximity sensors 21 and 22 oriented crosswise and substantially parallel to direction A respectively. More specifically, sensor 21 is oriented substantially perpendicular to direction A. Sensors 21 and 22 each emit relative recording signals relative to the distance between carriage 10 and sensor 21 and sensor 22 respectively.

In the present description, the term "fault" is intended to mean an operating condition which is already causing production problems, e.g. a relatively high percentage of reject cigarettes, or a condition which, if not corrected, would presumably result in production problems.

Control unit 20 also comprises a computer 23 connected to sensors 21 and 22 and for processing the recording signals from sensors 21 and 22 to determine a possible fault. In an embodiment not shown control unit 20 only comprises sensor 21, and sensor 22 is eliminated.

In actual use, computer 23 receives the recording signals, compares the recording signals with at least one reference data item to obtain a comparison data item, and determines a fault as a function of the comparison data item.

As described herein, the reference data item may comprise one or more elements, e.g. may be a single value or a matrix of values. Similarly, the comparison data item may comprise one or more elements, e.g. may be a single value or a matrix of values.

The comparison data item may be processed in various ways to determine the existence of a fault.

Computer 23 may acquire a recorded value as a function of the recording signal, and subtract the recorded value from a reference data item value to obtain a comparison data item value; and, in the event the comparison data item value exceeds a given threshold value, control unit 20 communicates the fault to the user by means of acoustic and/or visual signals and/or stops machine 1.

In some embodiments, computer 23 receives a number of recording signals relative to the position of carriage 10 at different operating cycles, calculates a mean of the recording signals, and compares the mean of the recording signals with the reference data item to obtain the comparison data item.

In some embodiments, in addition to or instead of the above embodiments, computer 23 receives a number of recording signals relative to the position of the carriage at different operating cycles, compares each recording signal with the reference data item to obtain a number of comparison data items, calculates a mean of the comparison data items, and determines a fault as a function of the mean of the comparison data items.

In some embodiments, in addition to or instead of the above embodiments, computer 23 obtains a number of comparison data items, determines a time pattern of the comparison data items or comparison data item means, and programs maintenance to correct the fault as a function of the time pattern of the comparison data items or comparison data item means.

Preferably, computer 23 determines a test curve K (FIG. 2) by which to extrapolate the time pattern of the comparison data items or comparison data item means, and programs maintenance work as a function of the instant in which test curve K intersects a reference curve R.

More specifically, maintenance may be programmed at the exact instant in which test curve K intersects reference curve R, or at a given time interval before or after the instant in which test curve K intersects reference curve R.

Figure 2:
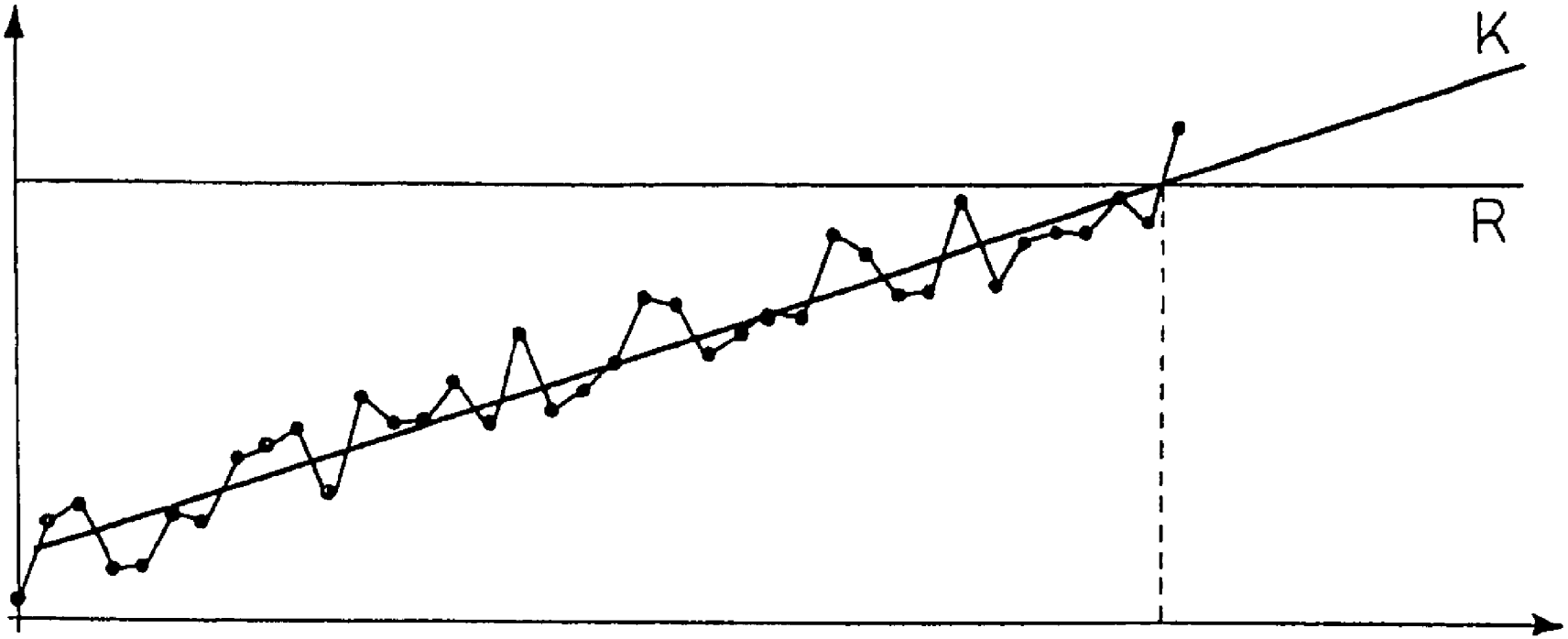
FIG. 2 shows a time graph of acquired values.

Purely by way of example, FIG. 2 shows a test curve, in which time is shown along the y axis, and the x axis shows the comparison data item values. K and R in FIG. 2 indicate a test curve and reference curve respectively.

As shown in FIG. 2, test curves K are preferably linear, and reference curves R preferably each define a respective constant value.

In some embodiments, in addition to or instead of the above embodiments, computer 23 receives a number of recording signals in time, determines a time pattern of the recording signals or recording signal means, and programs maintenance to correct the fault as a function of the time pattern of the recording signals or recording signal means.

Preferably, computer 23 determines a test curve K' by which to extrapolate the time pattern of the recording signals or recording signal means, and programs maintenance work as a function of the instant in which test curve K' intersects a reference curve R'.

More specifically, maintenance may be programmed at the exact instant in which test curve K' intersects reference curve R', or at a given time interval before or after the instant in which test curve K' intersects reference curve R'.

Figure 3:
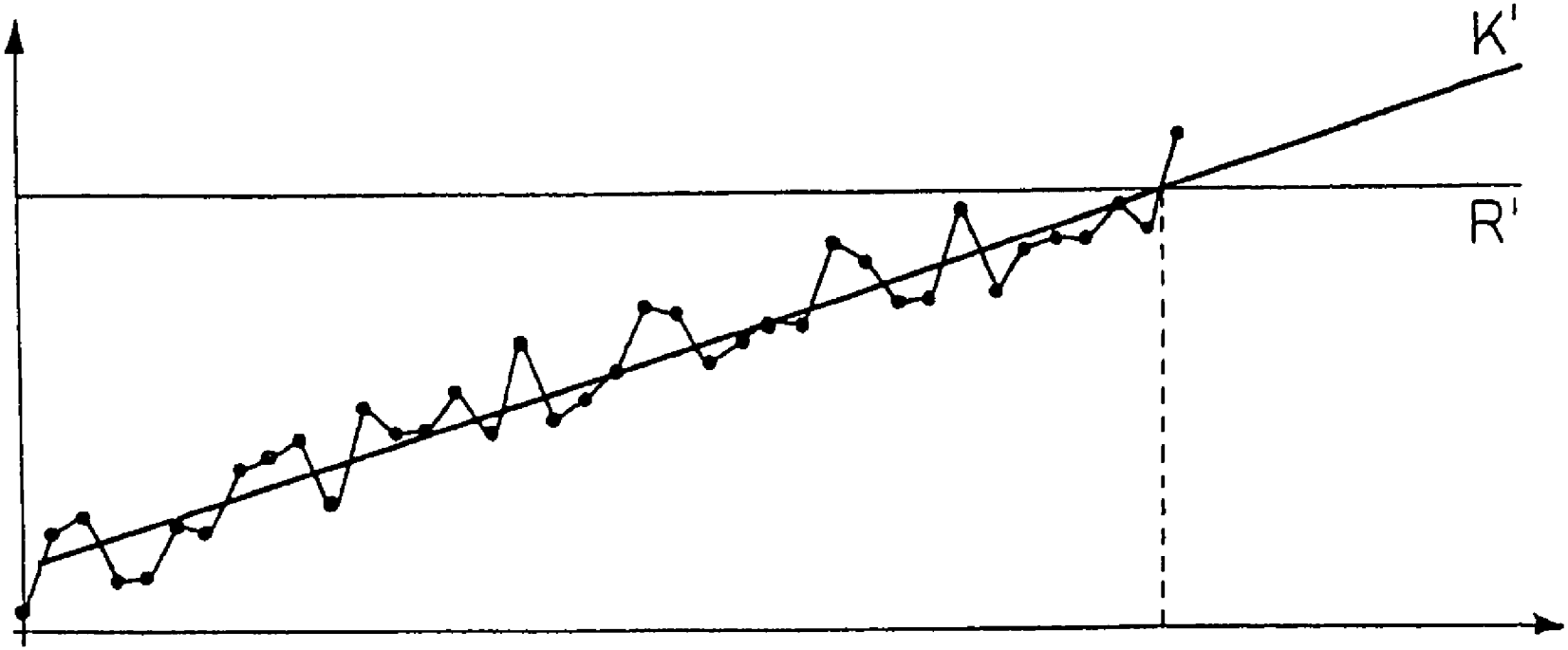
FIG. 3 shows a time graph of comparison data.

Purely by way of example, FIG. 3 shows a test curve, in which time is shown along the y axis, and the x axis shows the recorded values obtained by processing the recording signal. K' and R' in FIG. 3 indicate a test curve and reference curve respectively.

It should be pointed out that, in the present description, the operations referred to as being performed by computer 23 on the recording signals (e.g. mean and time pattern calculations) are intended as being performed directly on the recording signals or on processing of the recording signals.

It is important to note that, by comparing the recording signal and the reference data item and so determining the comparison data item, any incorrect positioning of carriage 10 at cutting plane 9 can be determined quickly and easily.

Moreover, the particular combination of component parts of cutting device 3 provides for programming maintenance to correct the fault in such a way as to prolong operation of machine 1 as long as possible before the fault can pose production problems on cutting device 5.

In particular, this is achieved in a particularly advantageous manner by determining the time pattern of the recording signals, comparison data items and/or their mean values.

The invention claimed is:

1. A cutting device for cutting at least one rod of material in the tobacco industry into substantially cylindrical portions, the cutting device (3) comprising cutting means (5) for cutting the rod transversely along a given cutting plane (9); a carriage (10) for accompanying the rod and the portions through the cutting plane (9); and an operating unit (11) for moving the carriage (10) back and forth in a travelling direction (A) crosswise to the cutting plane (9); the carriage (10) comprises at least one channel (12) for supporting the rod and the portions at the cutting plane (9), and through which the rod and the portions are fed in use; and the cutting device (3) being characterized by comprising a control unit (20), in turn comprising at least one proximity sensor (21, 22) for emitting at least one recording signal relative to the position of the carriage (10) with respect to at least one reference position, and a computer (23) which compares the recording signal with at least one reference data item to obtain at least one comparison data item and determine at least one fault of the operating unit (11) as a function of the comparison data item.

2. A device as claimed in claim 1, wherein the proximity sensor (21, 22) is oriented in a first orientation direction crosswise to the travelling direction (A).

3. A device as claimed in claim 1, wherein the proximity sensor (21, 22) is oriented in a first orientation direction substantially parallel to the cutting plane (9).

4. A device as claimed in claim 1, and comprising at least one further proximity sensor (21, 22) for emitting a further recording signal relative to the position of the carriage (10); the computer (23) comparing the recording signal and the further recording signal with at least one reference data item to obtain a comparison data item.

5. A device as claimed in claim 4, wherein the further proximity sensor (21, 22) is oriented in a second orientation direction crosswise to the first orientation direction.

6. A device as claimed in claim 5, wherein the second orientation direction is crosswise to the cutting plane (9).

7. A device as claimed in claim 5, wherein the second orientation direction is substantially parallel to the travelling direction (A).

8. A device as claimed in claim 1, wherein the computer (23) receives a number of recording signals relative to the position of the carriage (10) at different operating cycles, calculates a mean of the recording signals, and compares the mean of the recording signals with the reference data item to obtain the comparison data item.

9. A device as claimed in claim 1, wherein the computer (23) receives a number of recording signals relative to the position of the carriage (10) at different operating cycles, compares each recording signal with the reference data item to obtain a number of comparison data items, calculates a mean of the comparison data items, and determines the fault as a function of the mean of the comparison data items.

10. A device as claimed in claim 1, wherein the computer (23) obtains a number of comparison data items, determines a time pattern of the comparison data items or of the means of the comparison data items, and programs maintenance to correct said fault as a function of the time pattern of the comparison data items or of the means of the comparison data items.

11. A device as claimed in claim 10, wherein the computer (23) determines a first test curve (K) by which to extrapolate the time pattern of the comparison data items or of the means of the comparison data items, and programs maintenance as a function of the instant in which the first test curve (K) intersects a first reference curve (R).

12. A device as claimed in claim 1, wherein the computer (23) receives a number of recording signals in time, determines a time pattern of the recording signals or of the means of the recording signals, and programs maintenance to correct said fault as a function of the time pattern of the recording signals or of the means of the recording signals or the means of the recording signals.

13. A device as claimed in claim 12, wherein the computer (23) determines a second test curve (K') by which to extrapolate the time pattern of the recording signals or of the means of the recording signals, and programs maintenance as a function of the instant in which the second test curve (K') intersects a second reference curve (R').

14. A device as claimed in claim 11, wherein the reference curve (R, R') is substantially constant.

* * * * *